US006249981B1

(12) United States Patent
Shu

(10) Patent No.: US 6,249,981 B1
(45) Date of Patent: Jun. 26, 2001

(54) STRUCTURE OF A PENCIL SHARPENER

(76) Inventor: Ming-Tay Shu, P.O. Box 82-144, Taipei (TW)

( * ) Notice: Subject to any disclaimer, the term of this patent is extended or adjusted under 35 U.S.C. 154(b) by 0 days.

(21) Appl. No.: 09/332,052

(22) Filed: Jun. 14, 1999

(51) Int. Cl.[7] ..... B43L 23/00
(52) U.S. Cl. ..... 030/457; 30/457; 144/28.5
(58) Field of Search ..... 030/451, 453, 030/454, 457, 458; 144/28.5

(56) References Cited

U.S. PATENT DOCUMENTS 3,556,182 * 1/1971 Tanigami ..... 144/28.5
3,678,975 * 7/1972 Imanishi et al. ..... 144/28.5
3,746,061 * 7/1973 Nakazaki ..... 144/28.5
5,052,453 * 10/1991 Chen ..... 144/28.5
5,161,587 * 11/1992 Wu ..... 30/451

* cited by examiner

*Primary Examiner*—Hwei-Slu Payer
(74) *Attorney, Agent, or Firm*—A & J

(57) ABSTRACT

An improved structure of a sharpener comprising an ornamental seat, a light-emitting body, a fixing seat module, a spring, a conductive cap, a push rod, a main body containing a sharpening means, and a bottom cap, wherein the fixing seat module can be replaced by a circuit board, a musical disc and a sound mask. When a pencil is inserted into a sharpening aperture provided on the main body, the push rod is elevated and the light-emitting body at the top end of the fixing seat module is lighted. When the circuit board is used to replace the fixing seat module and a pencil is inserted into the sharpening aperture, the light-emitting body on the circuit board is lighted and music is produced. If the pencil is withdrawn from the main body, there is no electrical current provided to the circuit board, and thus, the music and the light are turned off.

11 Claims, 9 Drawing Sheets

(3 ~3)

(4 ~4)

STRUCTURE OF A PENCIL SHARPENER

BACKGROUND OF THE INVENTION (a) Field of the Invention

The present invention relates to an improved structure of a pencil sharpener, and in particular, to a pencil sharpener which has pencil sharpening function and has new function of light emitting and music producing.

(b) Description of the Prior Art

ROC patent publication no. 187347 entitled "A Pencil Sharpener With Music And Light Indiction Effect" discloses a pencil sharpener comprising a main body having an aperture for the insertion of a pencil, one lateral edge of the aperture being provided with a blade and being connected to an IC musical disc, a buzzer and a light bulb, and the other lateral edge of the aperture being located near to the center of the pencil tip, a conductive spring disc being connected to the IC musical disc, and the light bulb.

After a pencil has been sharpened, the tip of the pencil causes the blade and the conductive spring disc to electrically connect to a power source, which forms a closed circuit to produce a sound and light effect to indicate that the pencil has already been sharpened.

The conventional pencil sharpener structure employs the pencil tip to simultaneously touch the blade and the conductive spring to produce a closed circuit so that electrical current will pass through the pencil tip from the blade to the conductive blade. However, the following drawbacks are found in this conventional art;

1) Friction is formed when the conductive spring and the pencil tip are in contact. The pencil tip will be scratched and the conductive spring will be worn out after a long period of use.
2) Although the pencil tip is conductive, its conductivity is not as good as metallic materials. In other words, the conductivity of the pencil tip is poor.
3) Music is only played after the pencil has been sharpened, therefore, the process of sharpening is dull without music.

SUMMARY OF THE PRESENT INVENTION

Therefore, it is an object of the present invention to provide an improved structure of a sharpener comprising an ornamental seat, a light-emitting body, a fixing seat module containing a plurality of batteries, a conductive spring, a conductive cap, a push rod, a main body containing a sharpening means, a bottom cap, characterized in that a conic-shaped sharpening aperture is provided to the sharpening means, the top end of the sharpening means has a push rod, and a push button is formed at the front end of the push rod, the push button passes through a hole at the top end of the sharpening means into the sharpening aperture, a protruded block is mounted at the top center of the push rod and is engageable with the conductive cap having urged by a spring at one end, the other end of the spring surrounds the fixing seat having the light-emitting body mounted on the top thereof, a straight leg of the light-emitting body is insertable into the fixing seat and is connected to the negative terminal of the batteries, the other leg is bent so as to be mounted at the exterior of the fixing seat and is in contact with the top end of the spring, thereby, a pencil inserted into the sharpening aperture urges the push rod to move upward together with the conductive cap, which in turn, causes the conductive cap to touch the positive terminal of the batteries within the fixing seat, thus electric current passes through the conductive cap, the spring, and to the bent leg of the light-emitting body so as to produce light.

Another aspect of the present invention is to provide an improved structure of a sharpener comprising an ornamental seat, a light-emitting body, a circuit board module, a spring, a push rod, a main body containing a sharpening means, a bottom cap, characterized in that a conic-shaped sharpening aperture is provided to the sharpening means, the top end of the sharpening means has a push rod and a push button is formed at the front end of the push rod, the push button passes through a hole at the top end of the sharpening means into the sharpening aperture, a protruded recess is formed at the top of the push rod, the circuit board module consists of a circuit board, a plurality of batteries at the bottom face of the circuit board, a musical disc on the protruded slot of the push rod, a multi-pore sound mask to protect the musical disc, and the spring in between the circuit board and the push rod, thereby, pencil inserted into the sharpening slot urges the push button to move upward together with the musical disc and the sound mask so that the conductive switch at the bottom of the circuit board is in contact with the top end of the sound mask to produce sound and light.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
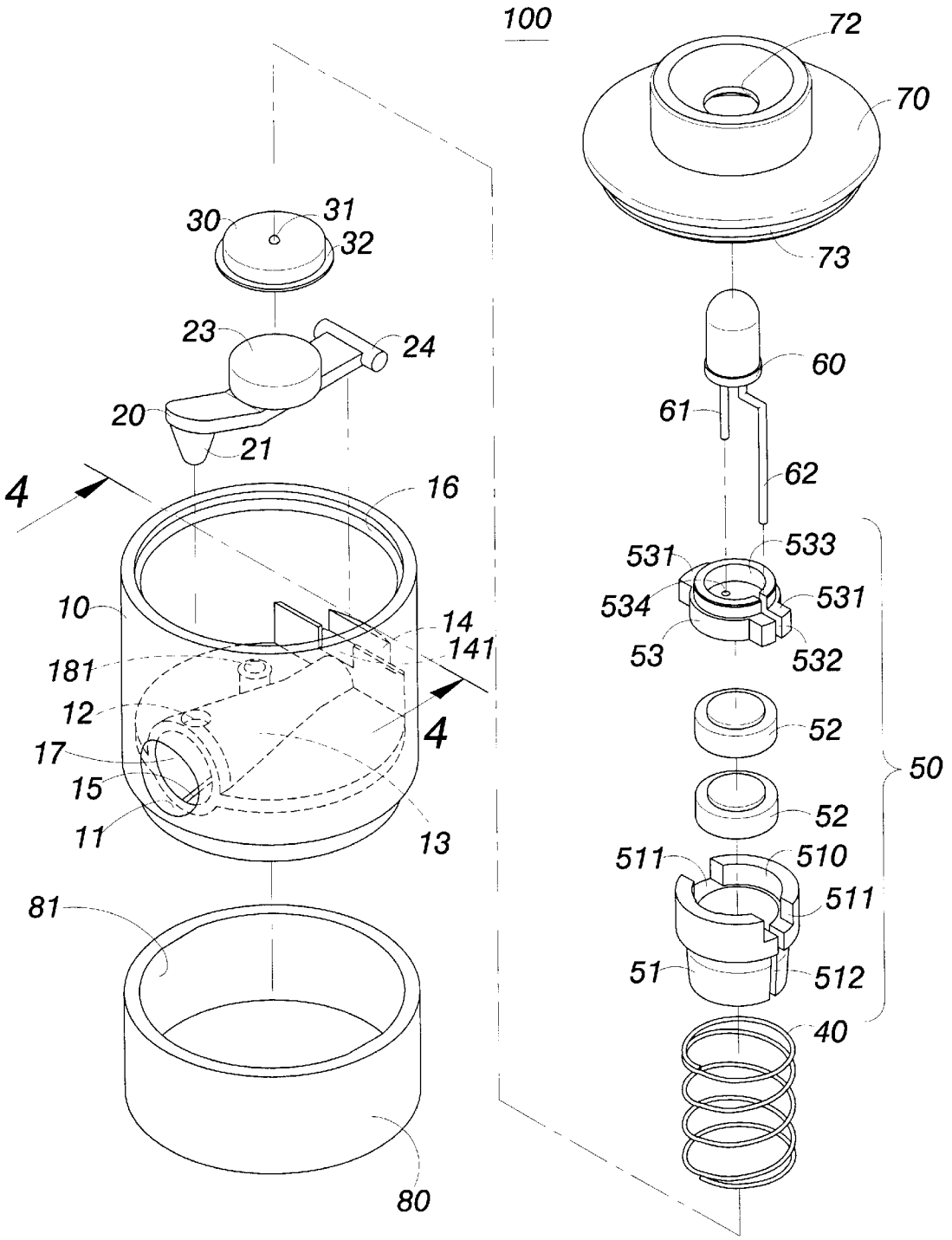
FIG. 1 is a perspective exploded view of the pencil sharpener of the present invention.

Referring to FIG. 1, there is shown an improved structure of a pencil sharpener 100 comprising an ornamental seat 70, a main body 10 mounted with a sharpening means 13 at the bottom of the ornamental seat 70, a push rod 20 mounted on the sharpening means 13, a conductive cap 30 mounted on the top of the push rod 20, a conductive spring 40 mounted on the conductive cap 30, a fixing seat module 50 mounted to top of the conductive spring 40, a light-emitting body 60 mounted on the top end of the fixing seat module 50, wherein the fixing seat module 50 includes a battery seat 51, two batteries 52 and a light-emitting seat 53. In accordance with the present invention, the battery seat 51 is provided at the top end of the spring 40, and the batteries 52 are mounted within the battery seat 51, and the light-emitting seat 53 is mounted at the top end of the battery seat 51.

Figure 2:
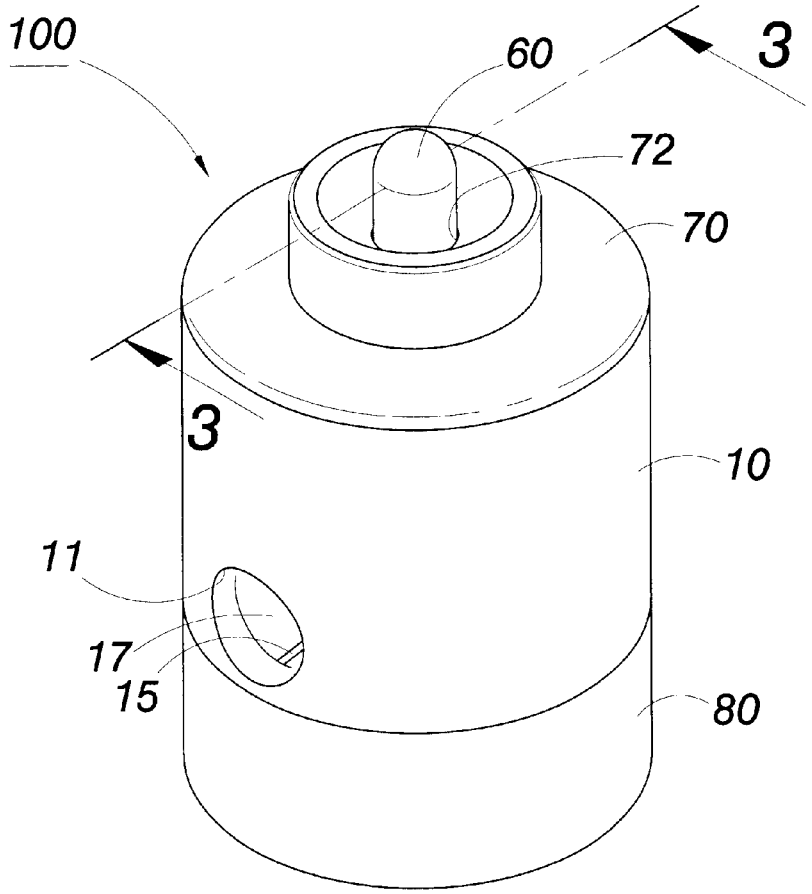
FIG. 2 is a perspective view of the pencil sharpener of FIG. 1 in accordance with the present invention.

The shape of the pencil sharpener 100 of the present invention is shown in FIG. 2.

Figure 3:
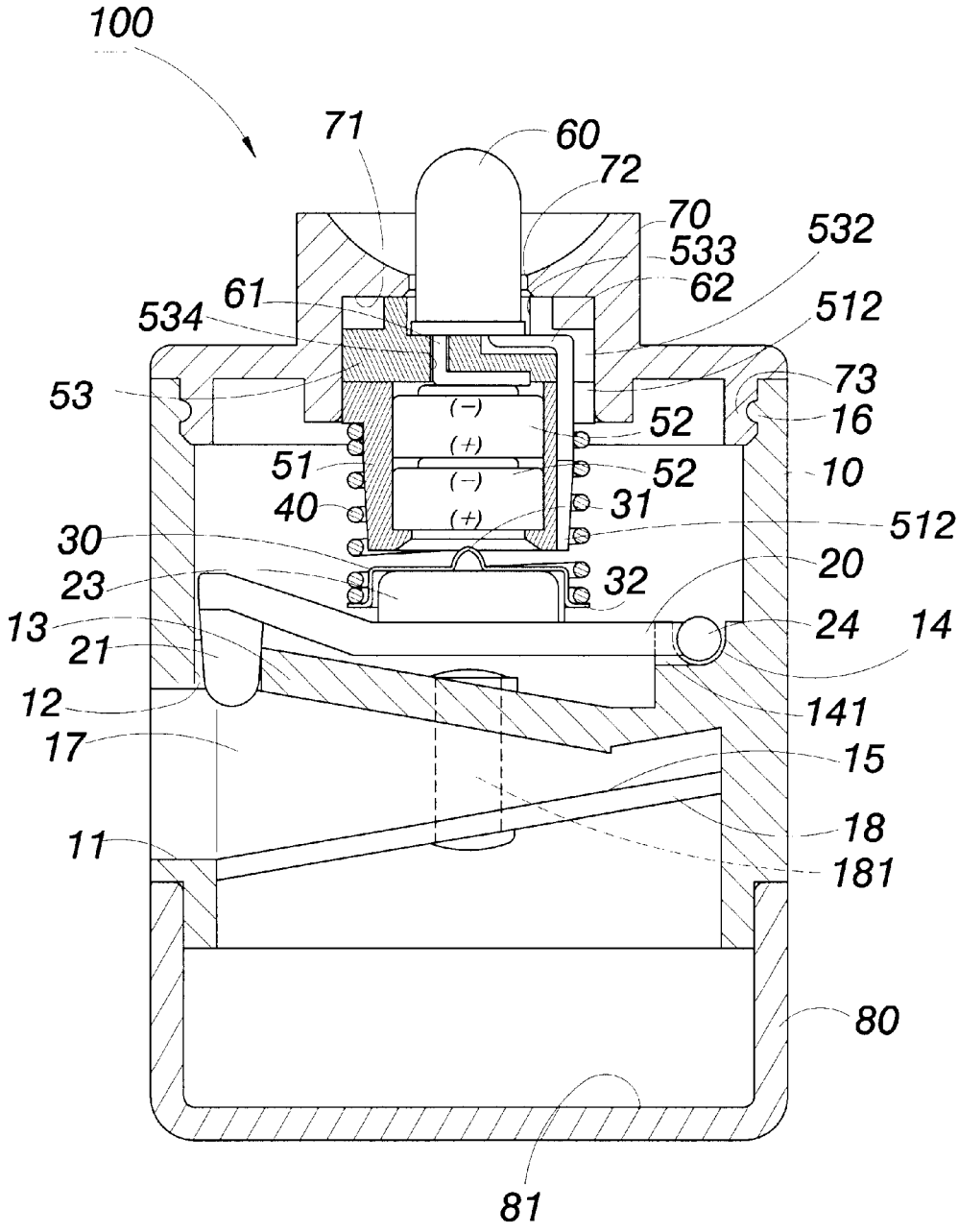
FIG. 3 is a sectional view of the pencil sharpener of FIG. 1 (sectional view along line 3—3 of FIG. 2).
Figure 4:
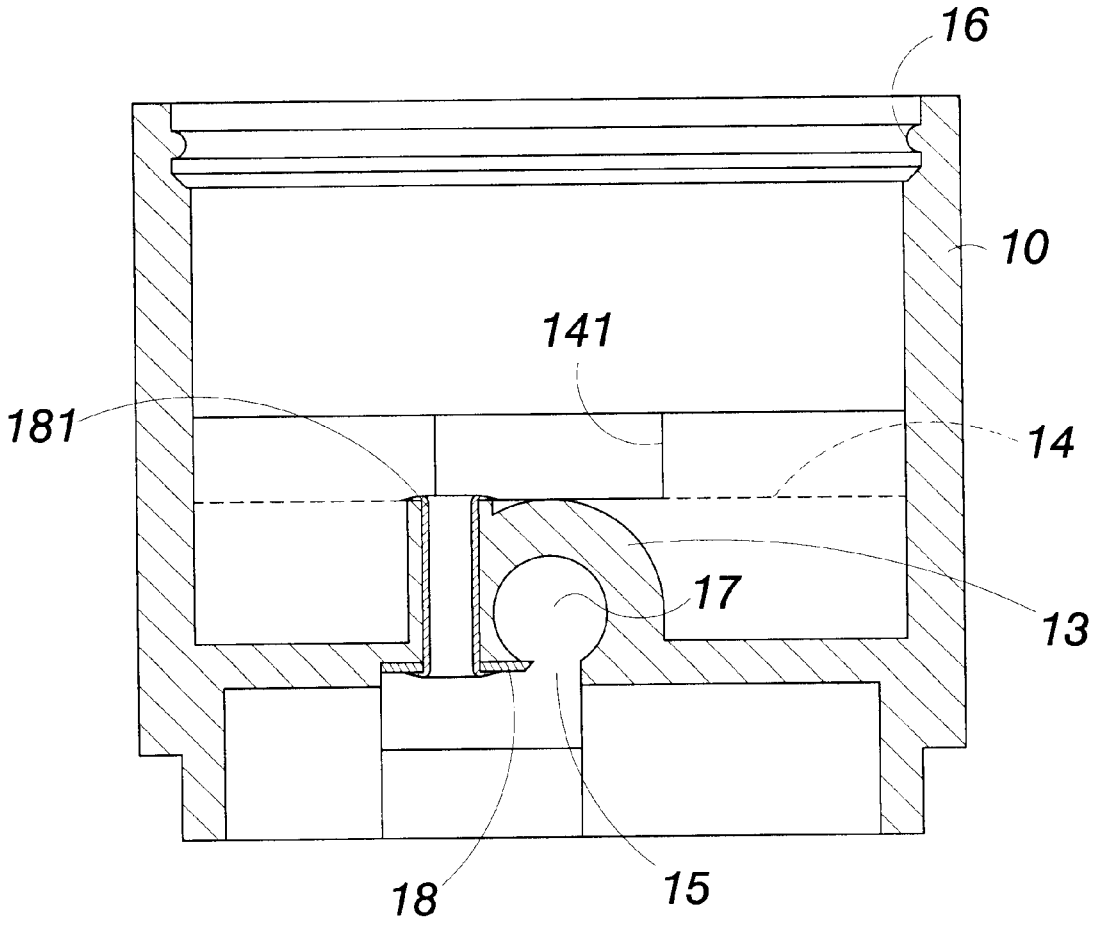
FIG. 4 is a sectional view along line 4—4 of the sharpener of FIG. 1 of the present invention.

Referring to FIGS. 1 and 3, FIG. 3 is a sectional view along line 3—3 of FIG. 2. The main body 10 is provided with a sharpening means 13, and has a conic-shaped sharpening aperture 17. A sharpening hole 11 is provided at the front of the sharpening aperture 17. At the lateral side of the cut 15, a blade 18 is provided and is slight mounted to the sharpening aperture 17 and is fastened with a fastening peg 181 (refer to FIG. 4).

In accordance with the present invention, a push rod 20 is mounted at the top end of the sharpening means 13. The rear end of the push rod 20 is a rotating shaft 24 and is positioned within the groove 14 at the inner wall of the rear end of the main body 10. The push rod 20 is extended from the center of the groove 14 to the notch 141 and the bottom of the front end of the push rod 20 is provided with a push button 21 which is protruded downward. The push button 21 passes through a small hole 12 at the top end of the sharpening means 13 and enters the sharpening aperture 17. Further, a circular shaped, protruded block 23 is provided at the top end of the push rod 20 and is insertable into a conductive cap 30. The conductive cap 30 is made of metallic materials. The top end of the cap 30 is provided with a protrusion 31 for contact with the batteries 52. In addition, the external edge of the conductive cap 30 is a protruded rim 32 which can be used to urge the top end of the conductive spring 40. The other end of the spring 40 surrounds the exterior of the battery seat 51.

In accordance with the present invention, the battery seat 51 is a hollow slot having a top recess 510. At the two lateral side of the top recess, a recess 511 is provided. One of the recess 511 is provided with a vertical cut slot 512. The two lateral edges of the light-emitting seat 53 are provided with a protruded block 531 which can be engaged with the recess 511 of the battery seat 51 such that the light-emitting seat 53 is firmly mounted to the battery seat 5 1. One of the protruded blocks 531 has a vertical cut slot 532 and aligns with the vertical cut slot 512 of the battery seat 51 for the mounting of one of the contacting leg 62 of the light-emitting body 60. The top recess 533 of the light-emitting seat 53 is provided with an insertion hole 534 for the adaptation of the other conductive leg 61 (straight leg) of the light-emitting body.

One conductive leg 61 of the light-emitting body 60 is straight which can be inserted into the insertion hole 534 of the light-emitting seat 53 and in contact with the negative terminal of the batteries 52. The other conductive leg 62 is a bent leg which is mounted across the light-emitting seat 53, the cut slot 532, 512 of the battery seat 51, and in contact with the top end of the spring 40.

The external wall of the lower end of the ornamental seat 70 is an circular groove 73 for the mounting of the protruded rim 16. The top seat 74 at the top end of the ornamental seat 70 is provided with an opening 72 at the centre thereof for the light-emitting body 60 to pass through from the bottom to the top. The bottom end of the ornamental seat 70 has an inner slot 71 (refer to FIG. 3) to hold the light-emitting seat 53 and the battery seat 51.

In accordance with the present invention, the lower end of the main body 10 is mounted with a bottom cap 80 having a receptacle 81 to collect the pencil debris when a pencil 91 is sharpened.

Figure 5:
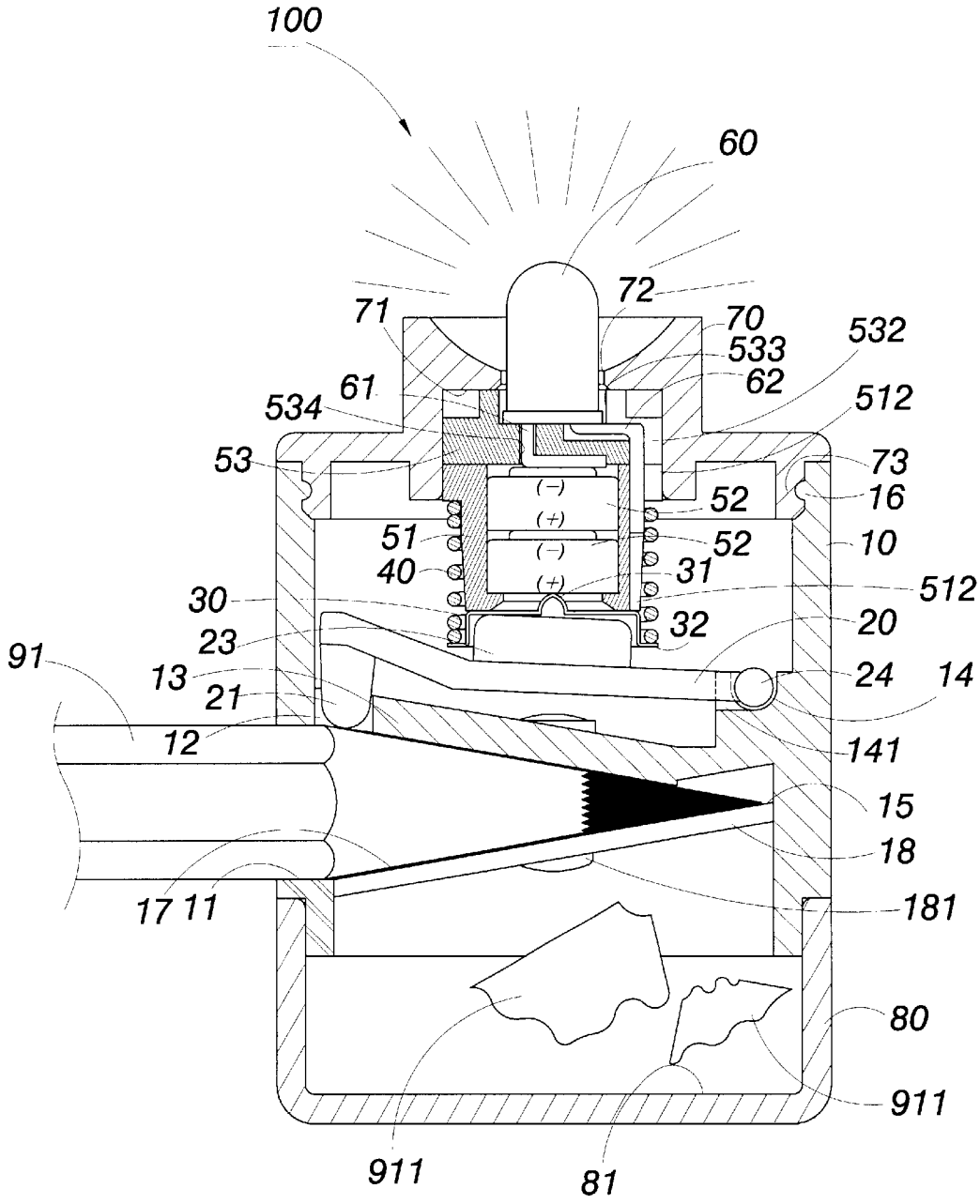
FIG. 5 is a sectional view showing the pencil sharpener being used to sharpen a pencil.

Referring to FIG. 5, when a pencil 91 is inserted into the sharpening aperture 17, the push button 21 urged by the pencil 91 moves upward and the push rod 20 also rotatably moves upward with the rotating shaft 24 as the center. The conductive cap 30 also moves upward at the same time. At this moment, the protrusion 31 at the top face of the conductive cap 30 contacts with the positive terminal of the batteries and electrical current passes to the conductive cap 30, and the spring 40 and then to the conductive contact leg 62 such that the light-emitting body 60 is lighted. At this instance, the pencil debris 911 will be collected within the bottom cap 80.

When the pencil 91 is withdrawn, the push button is not pressed and the spring 40 pushes away the conductive cap 30 and the push rod 20, such that the protrusion 31 of the conductive cap 30 is not contact with the batteries 52. Thus, the light-emitting body 60 is not lighted.

Figure 6:
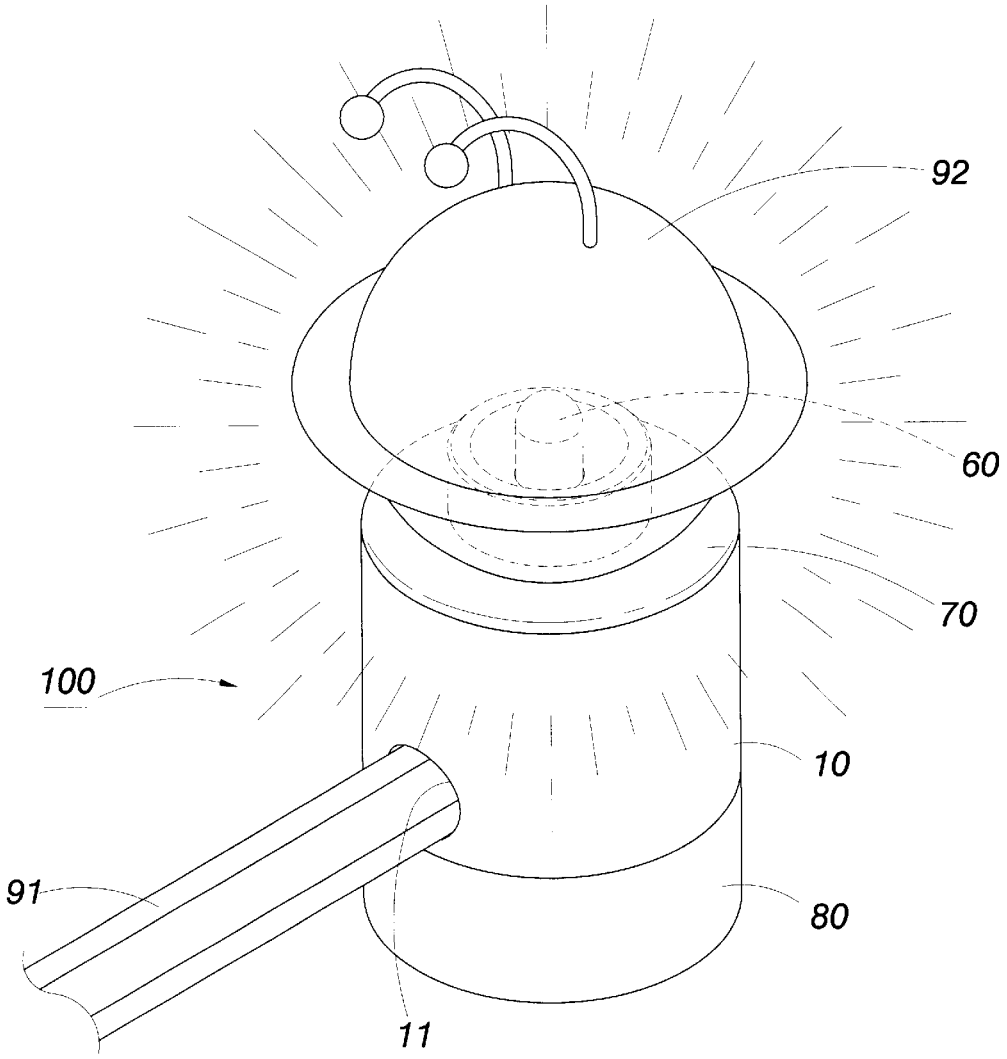
FIG. 6 is a schematic view showing a light transrnitive ornamental object being used with the pencil sharpener of the present invention.

Referring to FIG. 6, the ornamental seat 70 can be mounted with a light-transmittive ornamental object 92. The bottom section of the ornamental object 92 is provided with a slot to allow the engagement with the top seat 74 of the ornamental seat 70.

Figure 7:
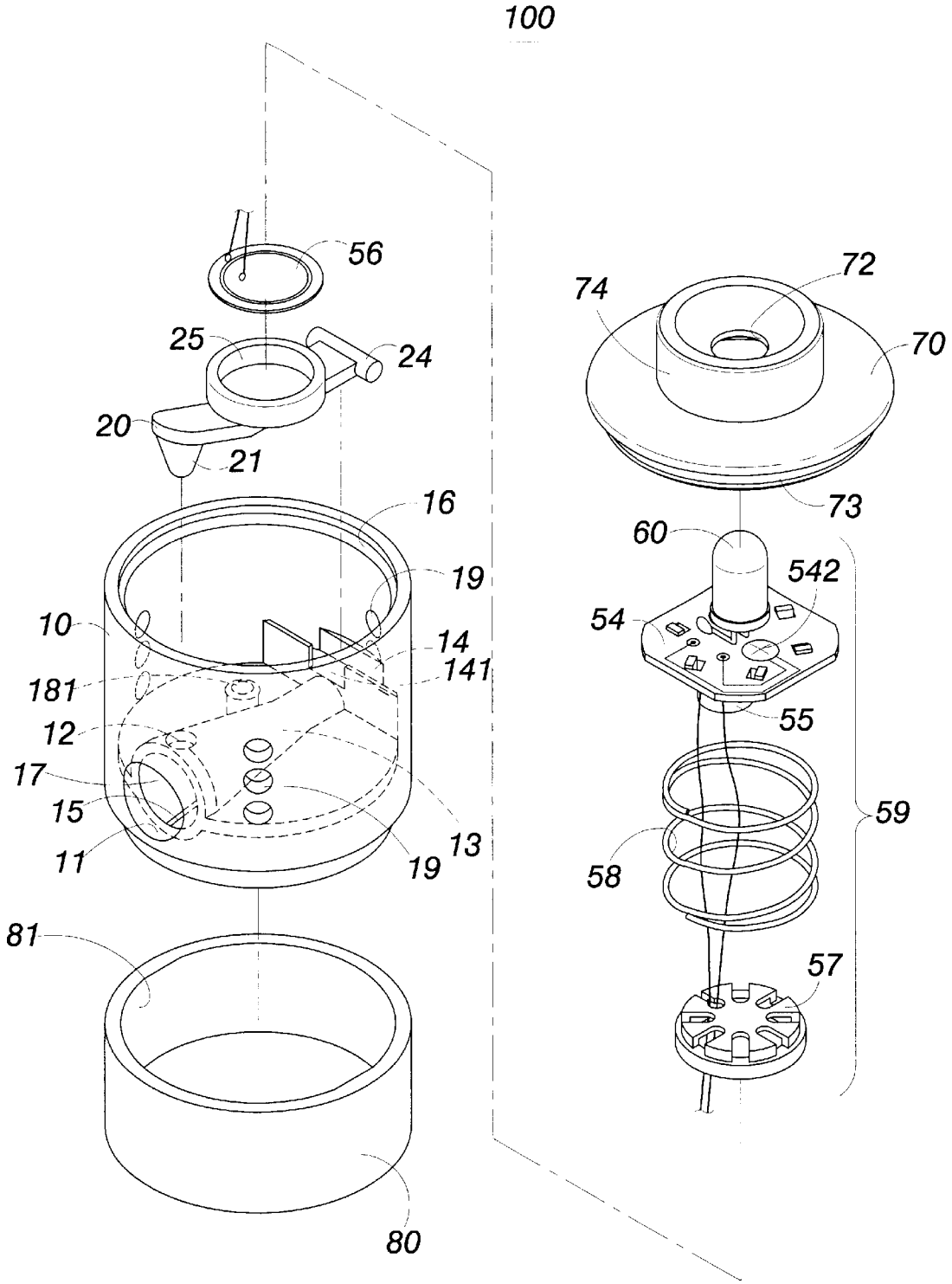
FIG. 7 is a perspective exploded view of the pencil sharpener of another preferred embodiment.

FIG. 7 shows another preferred embodiment of the present invention. The differences between the embodiment of FIG. 7 and the embodiment in FIG. 1 are that a plurality of sound pores 19 are provided to the wall of the main body 10 and a circuit board module 59 is used to replace the fixing seat module 50. The circuit board module 59 includes a circuit board 54 mounted within the inner slot 71 of the ornamental seat 70, a battery 55 mounted within a metal case 541 at the bottom of circuit board 54, a musical disc 56 being positioned at the protruded slot of the push rod 20, a musical mask 57 with multiple pores, and a spring 58 being mounted between the push rod 20 and the circuit board 54.

Figure 8:
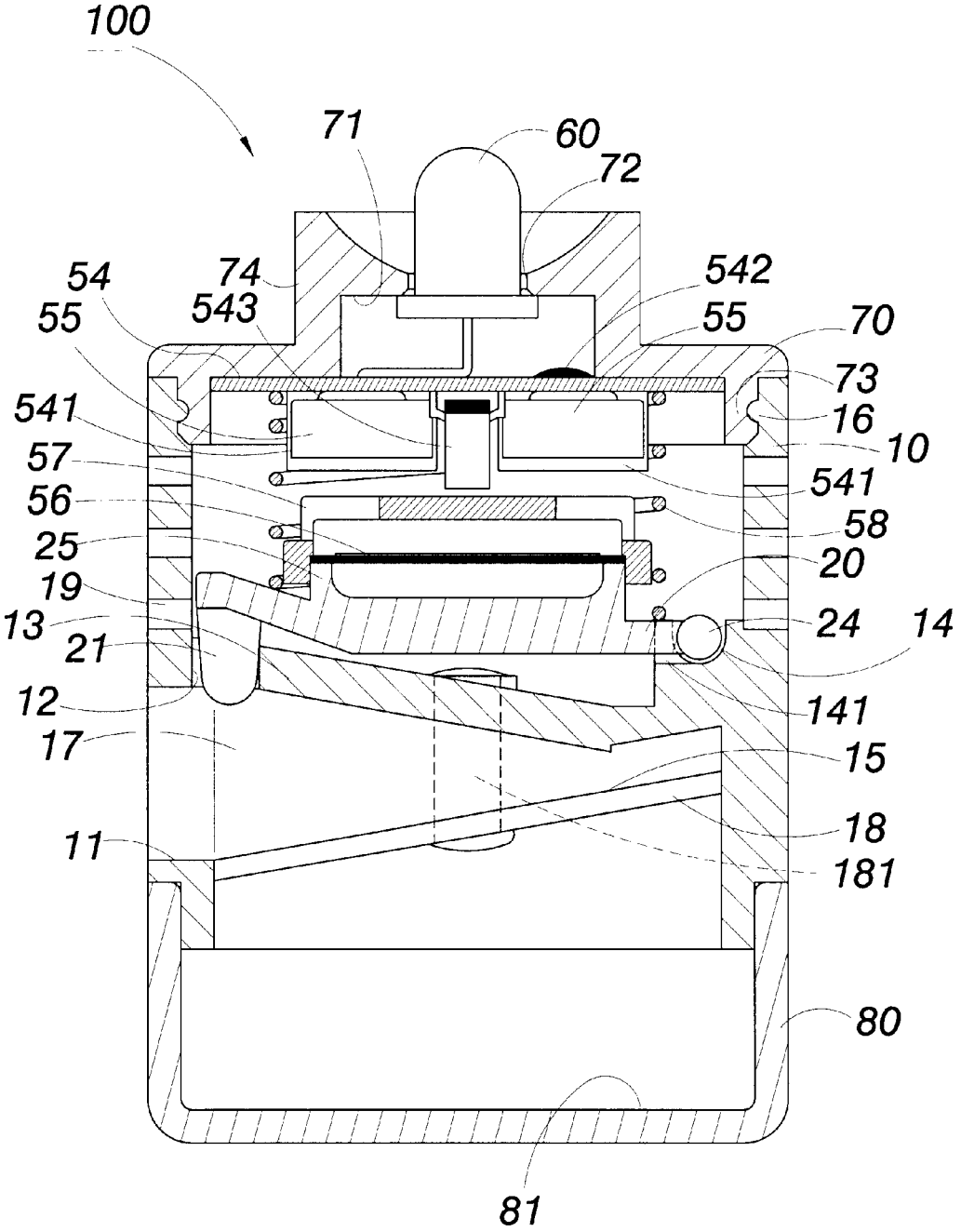
FIG. 8 is a sectional view of the pencil sharpener along ling 8—8 of FIG. 7.

Referring to FIGS. 5, 7 and 8, the two conductive legs 61, 62 of the light-emitting body 60 is mounted to the circuit board 54. On the circuit board 54, a musical IC 542 can cause the musical disc 56 to produce music, and a rubber conductive switch 543 is provided at the center of the circuit board 54. There is a distance between the conductive switch 543 and the musical mask 57 as a result of the extension force of the spring 58. The protruded recess 25 of the push rod 20 is a hollow body to allow resonance formed by the musical disc 56.

Figure 9:
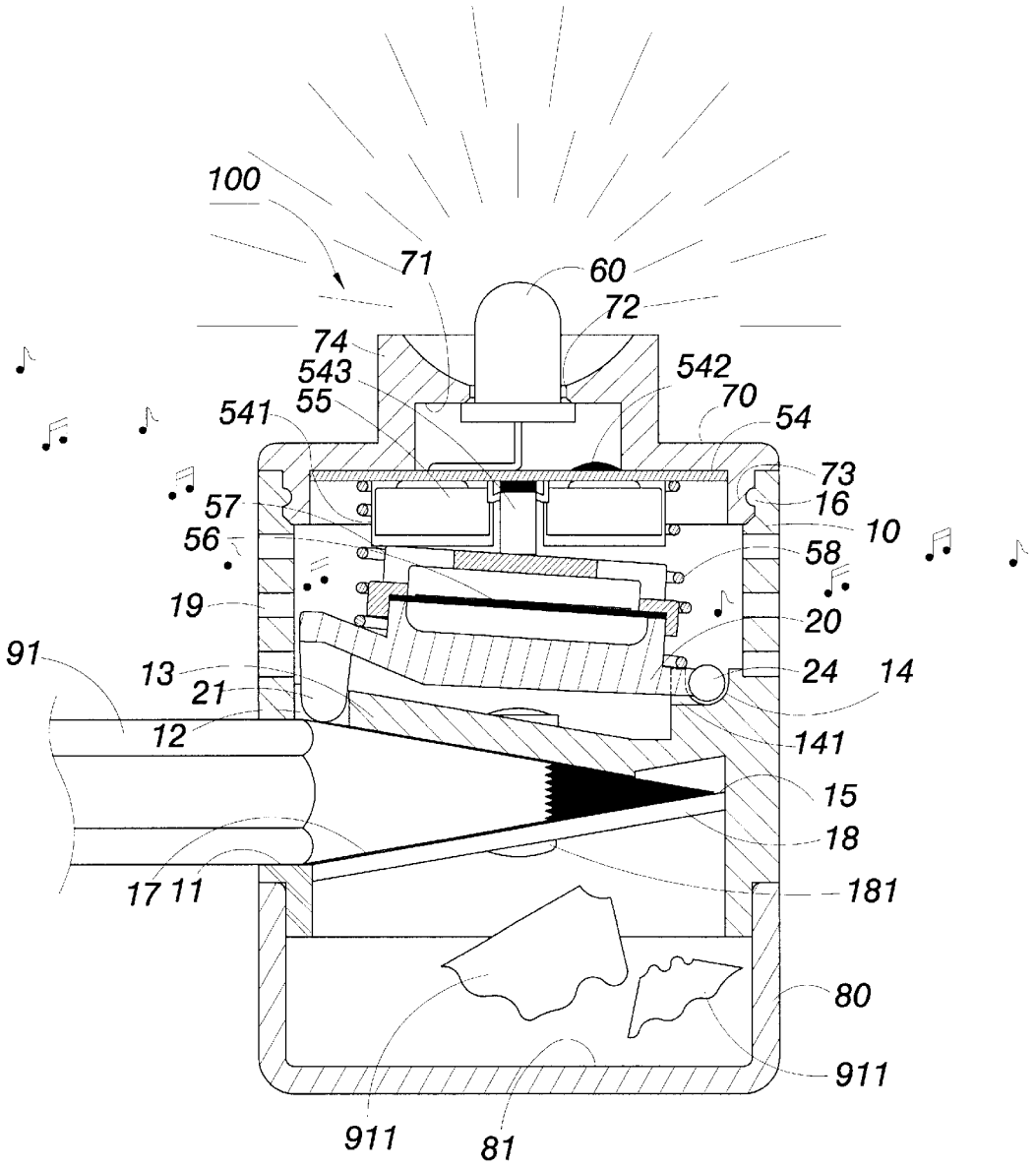
FIG. 9 is a sectional view of the pencil sharpener of FIG. 7.

Referring to FIG. 9, when the pencil 91 is inserted into the sharpening aperture 17 of the main body 10, the push button 21 urged by the pencil 91 moves upward, and the push rod 20, together with the musical disc 56, and the musical mask 57 rotatably moves upward about the rotating shaft 24 as the shaft center. By means of the musical mask 57 to urge the conductive switch 543, electrical current is provided to the light-emitting body 60 and the musical IC 542 to cause the light-emitting body 60 to be lighted and the musical disc 56 to produce music. When the pencil 91 is withdrawn from the sharpening aperture 17 of the main body, the spring 58 urges the musical mask 57, the musical disc 56 and the push rod 20 to move downward. Thus, the musical mask 57 is disengaged from the conductive switch 543 and forms a distance in between. Thus, the pencil sharpener returns to the state as shown in FIG. 8.

It will be apparent to the art that various modifications and variations can be made accordingly to the present invention without departing from the spirit or scope of the invention. Thus, it is intended that the present invention covers the modifications and variations of the invention provided they come with the scope of the appended claims and their equivalents.

What is claimed is:

1. An improved structure of a sharpener comprising an ornamental seat, a light-emitting body, a fixing seat module containing a plurality of batteries, a conductive spring, a conductive cap, a push rod, a main body containing a sharpening means, a bottom cap, characterized in that a conic-shaped sharpening aperture is provided to the sharpening means, the top end of the sharpening means has the push rod, and a push button is formed at the front end of the push rod, the push button passes through a hole at the top end of the sharpening means into the sharpening aperture, a protruded block is mounted at the top center of the push rod and is engageable with the conductive cap having urged by an end of the spring, the other end of the spring surrounds the fixing seat module having the light-emitting body mounted on the top thereof, a straight leg of the light-emitting body is insertable into the fixing seat module and is connected to the negative terminal of the batteries, the other leg of the light-emitting body is bent so as to be mounted at the exterior of the fixing seat module and is in contact with the top end of the spring, thereby, a pencil inserted into the sharpening aperture urges the push rod to move upward together with the conductive cap, which in turn, causes the conductive cap to touch the positive terminal of the batteries within the fixing seat module, thus electric current passes through the conductive cap, the spring, and to the bent leg of the light-emitting body so as to produce light.

2. An improved structure of a sharpener as set forth in claim 1, wherein a transparent or translucent ornamental object is mounted onto the ornamental seat.

3. An improved structure of a sharpener as set forth in claim 2, wherein the fixing seat module comprises a battery seat, the plurality of batteries, and a light-emitting seat, the battery seat being provided on the top end of the spring and the batteries being mounted within the battery seat, and the light-emitting seat being mounted on the top end of the battery seat for the mounting of the light-emitting body.

4. An improved structure of a sharpener as set forth in claim 3, wherein the battery seat is a hollow slot having a top recess having two lateral sides each being provided with a recess, a vertical cut slot being provided to the internal of one of the recesses, each lateral end of the light-emitting seat being provided with a protruded block which is mountable to the recess of the battery seat, one of the protruded blocks of the light-emitting seat being provided with a vertical cut slot which aligns with the vertical cut slot of the battery seat for the insertion of the bent leg of the light-emitting body.

5. An improved structure of a sharpener as set forth in claim 1, wherein the lower end, external wall of the ornamental seat is a circular groove for the engagement of a protruded rim of the main body, the center of the top of the ornamental seat being an opening for the mounting of the light-emitting body, the bottom end of the ornamental seat being formed into an inner slot for the mounting of the fixing seat module.

6. An improved structure of a sharpener as set forth in claim 1, wherein the rear end of the push rod is a rotating shaft having being mounted within a groove at the rear end of the main body, the push rod being protruded from a notch at the center of the groove and the bottom end of the push rod being provided with the push button.

7. An improved structure of a sharpener as set forth in claim 1, wherein the conductive cap has a protrusion on the top thereof to contact with the positive terminal of the batteries, and the external edge of the conductive cap is a protruded rim to urge the spring.

8. An improved structure of a sharpener comprising an ornamental seat, a light-emitting body, a circuit board module, a spring, a push rod, a main body containing a sharpening means, a bottom cap, characterized in that a conic-shaped sharpening aperture is provided to the sharpening means, the top end of the sharpening means has the push rod and a push button is formed at the front end of the push rod, the push button passes through a hole at the top end of the sharpening means into the sharpening aperture, a protruded recess is formed at the top of the push rod, the circuit board module consists of a circuit board, a plurality of batteries at the bottom face of the circuit board, a musical disc on the protruded recess of the push rod, a multi-pore sound mask to protect the musical disc, and the spring in between the circuit board and the push rod, thereby, pencil inserted into the sharpening aperture urges the push button to move upward together with the musical disc and the sound mask so that a conductive switch at the bottom of the circuit board is in contact with the top end of the sound mask to produce sound and light.

9. An improved structure of a sharpener as set forth in claim 8, wherein a transparent or translucent ornamental object is mounted onto the ornamental seat.

10. An improved structure sharpener as set forth in claim 8, wherein the lower end, external wall of the ornamental seat is a circular groove for the engagement of a protruded rim, of the main body, the center of the top of the ornamental seat is an opening for the mounting of the light-emitting body.

11. An improved structure sharpener as set forth in claim 8, wherein the rear end of the push rod is a rotating shaft having being mounted within a groove at the rear end of the main body, the push rod being protruded from a notch at the center of the groove and the bottom end of the push rod being provided with the push button.

* * * * *